US007384296B2

(12) United States Patent
Oma et al.

(10) Patent No.: US 7,384,296 B2
(45) Date of Patent: Jun. 10, 2008

(54) ELECTRICAL CONNECTOR WITH LATCH

(75) Inventors: Takayuki Oma, Tokyo (JP); Takeshi Miyazaki, Tokyo (JP); Hirokazu Umehara, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 209 days.

(21) Appl. No.: 11/359,609

(22) Filed: Feb. 23, 2006

(65) Prior Publication Data

US 2006/0216976 A1 Sep. 28, 2006

(30) Foreign Application Priority Data

Mar. 23, 2005 (JP) ..... 2005-082977

(51) Int. Cl.
*H01R 13/627* (2006.01)

(52) U.S. Cl. ..... 439/358; 439/353

(58) Field of Classification Search ..... 439/353, 439/354, 357, 358, 466, 468, 694, 855
See application file for complete search history.

(56) References Cited

U.S. PATENT DOCUMENTS 5,061,197 A * 10/1991 Kuzuno et al. ..... 439/262
5,100,339 A * 3/1992 Sato et al. ..... 439/354
5,746,618 A * 5/1998 Gauker ..... 439/352
6,478,635 B2 * 11/2002 Charles et al. ..... 439/851
6,902,438 B2 * 6/2005 Tsuyama ..... 439/694

FOREIGN PATENT DOCUMENTS

JP 4-35370 3/1994

* cited by examiner

*Primary Examiner*—Khiem Nguyen
(74) *Attorney, Agent, or Firm*—Kubotera & Associates, LLC

(57) ABSTRACT

An electrical connector (10) comprises a housing (11), a pair of resilient arms (14) extending from the housing (11) for resiliently flexing and deforming, a pair of lock portions (15) provided through the resilient arms (14) for engagement with engagement portions (40) of a mating connector (30) during a plug-in operation between the electrical connector (10) and the mating connector (30), and an operative portion (14B) provided on the resilient arms (14) and applying an operative force to the resilient arms (14) so that the resilient arms (14) flexes and deforms for releasing the engagement between the lock portions (15) and the engagement portions (40) of the mating connector (30).

10 Claims, 5 Drawing Sheets

ELECTRICAL CONNECTOR WITH LATCH

BACKGROUND OF THE INVENTION

1. Field of the Invention

This invention relates to an electrical connector, especially an electrical connector having functions of locking with and unlocking from a mating connector.

2. Description of the Related Art

This kind of electrical connector is disclosed in, for example, the below-mentioned Patent Document Number 1. In the Patent Document, an electrical connector comprises a resiliently flexible locking arm extending diagonally from both side faces of a housing. The locking arm has a lock portion, which engages a mating connector, at an intermediate position on the base side thereof in its extension direction, and an operative portion, which releases the engagement with the mating connector, on the free end side thereof.

When the electrical connector is plugged in the mating connector, the lock portion resiliently flexes to climb over an engagement portion of the mating connector. At the point where the lock portion has climbed over the engagement portion, the lock portion is released from the resilient flexibility so that the locking arm engages the engagement portion, thus completing the lock to prevent the coming off of the electrical connector. For removal of the connector, the locking arm is resiliently flexed toward a side wall of the housing by applying force to the operative portion to release the engagement. Then, the electrical connector is taken out from the mating connector.

Patent Document No. 1: Japanese Patent Application Unexamined Number 4-35370

For the purpose of firm locking engagement with the mating connector upon completion of the plug-in operation, the minimum amount of flexibility or displacement of the lock portion is required. In the Patent Document No. 1, since the lock portion is positioned on the base side of the locking arm and the operative portion is positioned on the free end side, the amount of displacement of the operative portion must be larger than that of the lock portion according to the principle of a fulcrum. Consequently, the electrical connector becomes large in the direction of the displacement of the locking arm, and also since the locking arm is long, the electrical connector becomes large in the direction of the extension of the locking arm too.

Therefore, one of the objectives of the present invention is to provide a small-sized electrical connector with resilient arms having functions of locking engagement and release of the locking engagement.

SUMMARY OF THE INVENTION

According to one aspect of the present invention, an electrical connector comprises a housing, at least one resilient arm extending from the housing and resiliently flexing and deforming, at least one lock portion provided in the resilient arm and engaging an engagement portion of a mating connector during a plug-in between with the mating connector, and an operative portion provided in the resilient arm and applying an operative force to the resilient arm so that the resilient arm flexes and deforms for releasing an engagement between the lock portion and the engagement portion of the mating connector.

The lock portion is provided in a range same as or overlapped with that of the operative portion in a removal direction of the resilient arm. In the present invention, since the lock portion and the operative portion are provided at the substantially same position in the same direction, even if the lock portion is provided at any positions allowing sufficient amount of the displacement of the lock portion, the amount of the displacement of the operative portion is the same as that of the lock portion. Consequently, the length of the resilient arm can be made small, which results in a small-sized electrical connector.

The lock portion and the operative portion may be provided in different peripheral faces of the resilient arm. The housing is connected to at least one cable, which extends from the housing at a position different from that of the resilient arm and in a direction perpendicular to a plug-in direction with the mating connector. This structure meets the requirement for a small-sized connector in the plug-in direction.

It is preferable that the lock portion is made as a projection having a tapered face, which receives, while abutting against the engagement portion of the mating connector, a pushing force from the engagement portion including a component of force in a plug-in direction toward the mating connector. The component of force in the plug-in direction toward the mating connector accelerates the plug-in of the electrical connector into the mating connector.

It is preferable that the mating connector or a receptacle electrical connector to be plugged in by the electrical connector comprises at least one first cut-off portion provided in a peripheral wall thereof at a position corresponding to that of the resilient arm to permit an insertion of the resilient arm of the electrical connector. Since the resilient arm is inserted into the cut-off portion, a space in the thicknesswise direction of the peripheral wall around the cut-off portion is utilized for accommodating the resilient arm, which makes the connector small in the thicknesswise direction thereof.

It is preferable that the receptacle electrical connector further comprises at least one second cut-off portion provided at a position corresponding to that of the cable connected to the electrical connector to permit an extension of the cable. Since the cable does not extend in the plug-in direction, the connector can be made small in the plug-in direction.

In the present invention, the resilient arm can be connected to the electrical connector at a rear position in the plug-in direction and extend forwardly so that at least part of the resilient arm is accommodated in the mating connector during the plug-in. Since the resilient arm does not extend rearwardly, the whole part of the resilient arm falls into the dimension of the connector in the plug-in direction. Also, at least part of the resilient arm falls into the external dimension of the connector in the thicknesswise direction of the resilient arm. Accordingly, the connector can be made small in these directions.

According to another aspect of the invention, the electrical connector comprises a pair of resilient arms opposing to each other in the displacement direction of the resilient arms, a pair of lock portions provided on both sides of the resilient arms and at least one crimp portion of a terminal for crimping the cable, wherein the crimp portion is provided in a range same as or overlapped with that between the pair of the lock portions in a widthwise direction of the resilient arm. Accordingly, even if the connector receives an external force when an excessive force is applied to the cable, since the lock portions and the engagement portion of the mating connector receive almost all of the external force, the terminal does not receive a large force.

According to the present invention, since the lock portion and the operative portion are provided at the substantially same position in the extension direction of the resilient arm, a sufficient amount of the displacement of the lock portion and the same amount of the displacement of the operative portion can be obtained. Accordingly, the resilient arm can be made small and the electrical connector becomes small-sized.

BRIEF DESCRIPTION OF THE DRAWINGS

FIG. 1 is a perspective view of a pair of electrical connectors according to an embodiment of the present invention, showing the condition before a plug-in;

DESCRIPTION OF THE PREFERRED EMBODIMENTS

The embodiments of the present invention will be now described below with the accompanying drawings.

Figure 1:
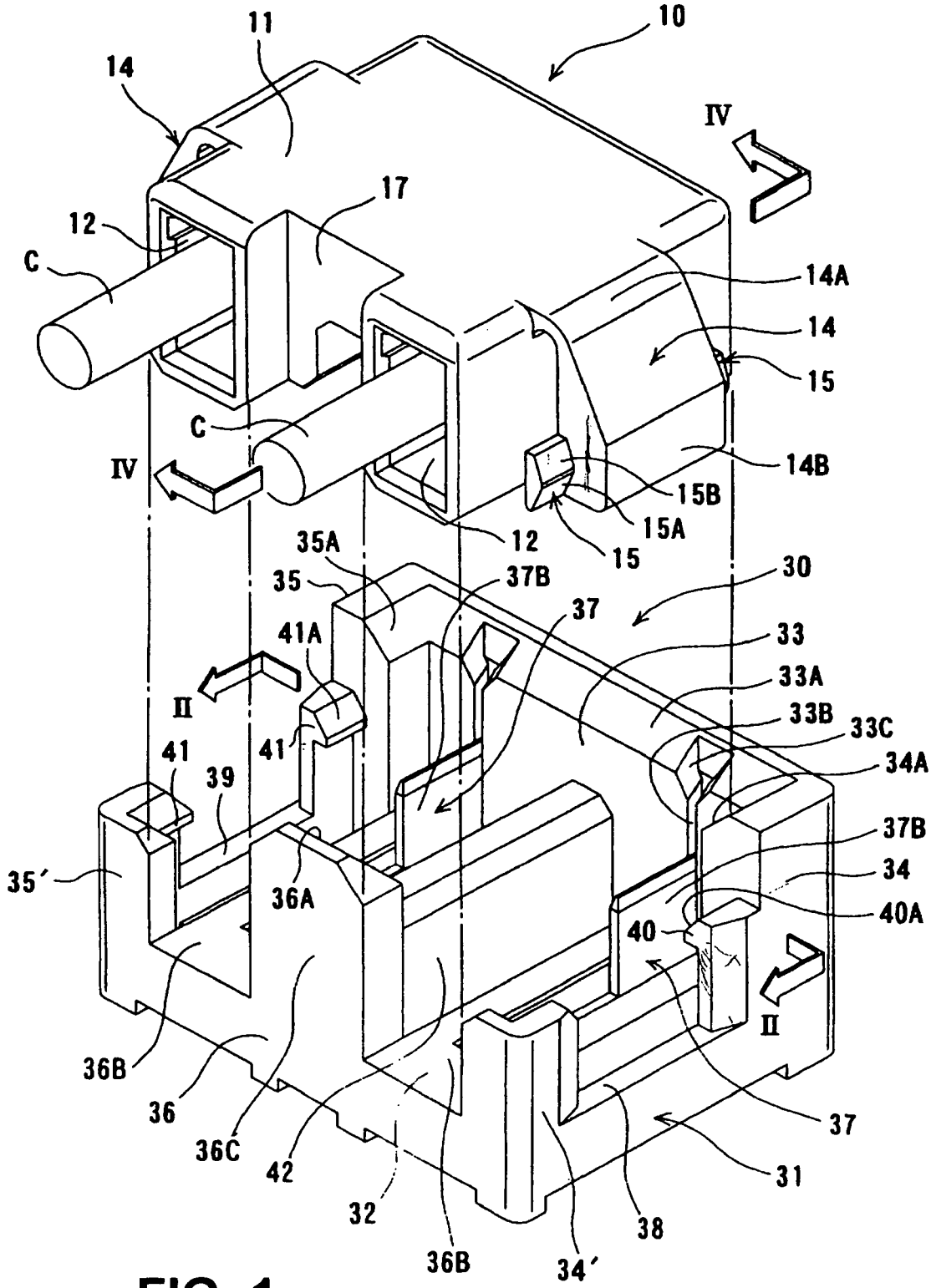
Figure 2:
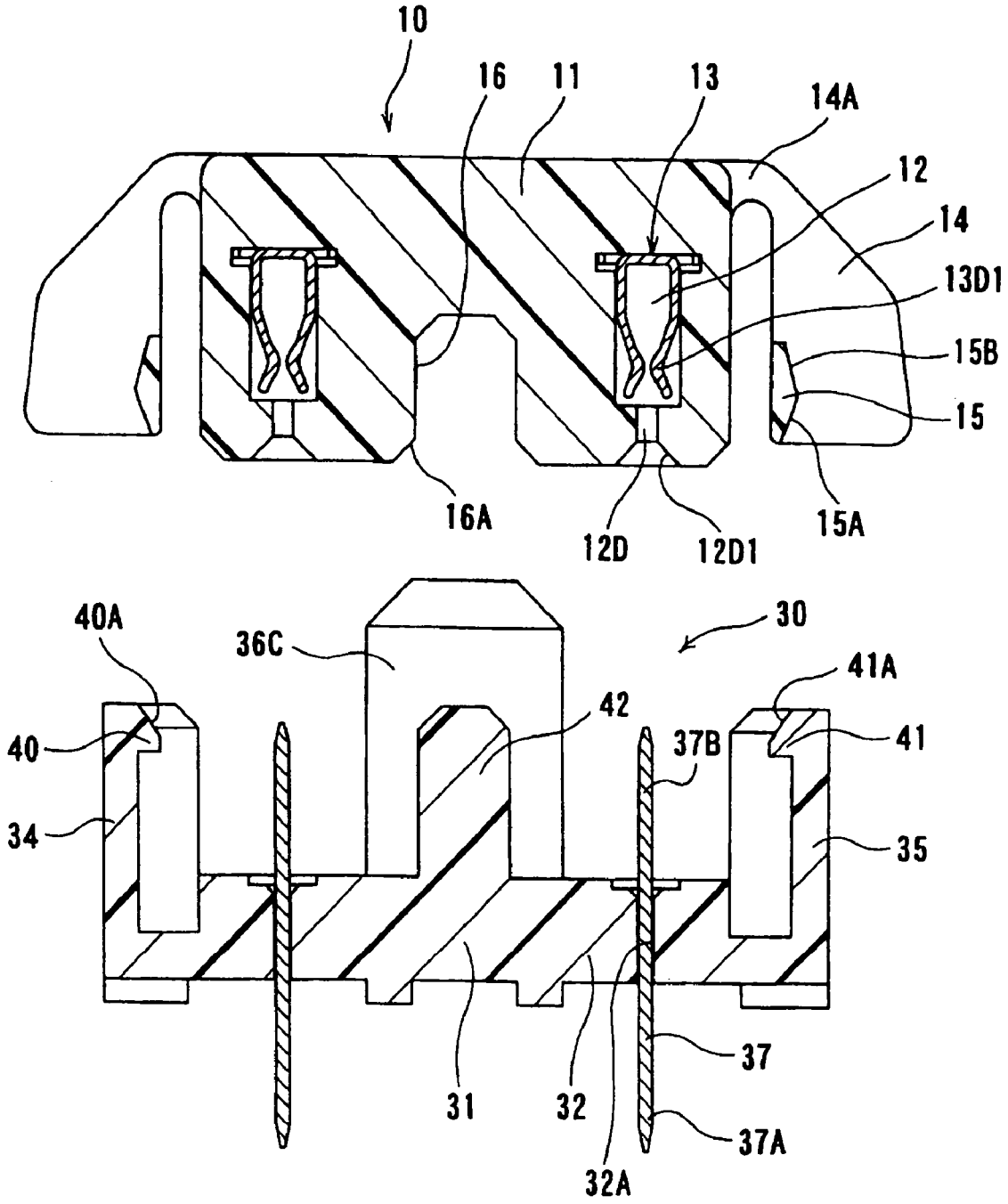
FIG. 2 is a sectional view of the electrical connectors taken along the line II-II of FIG. 1.
Figure 3:
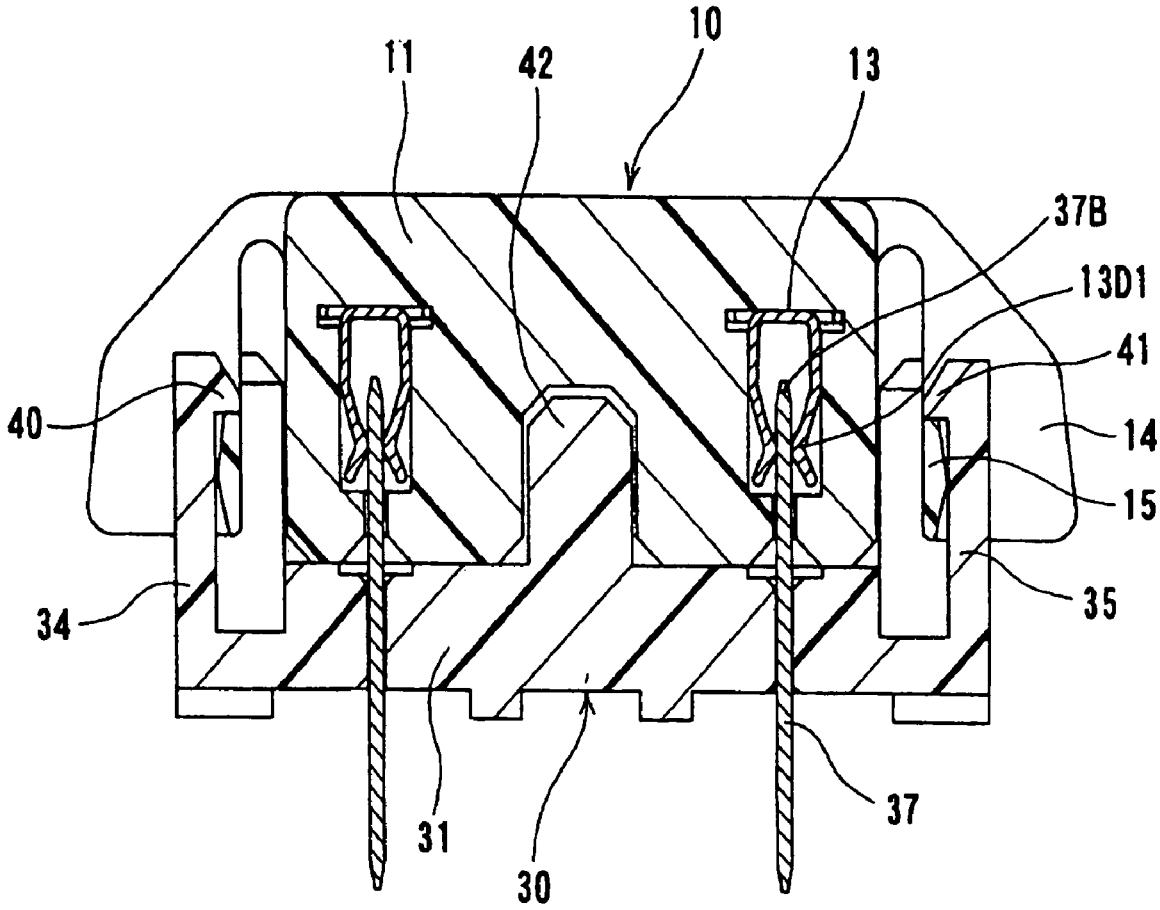
FIG. 3 is a sectional view of the electrical connectors in the same section as that of FIG. 2, showing the condition after the plug-in operation.

As shown in FIGS. 1 and 2, an electrical connector 10 has two hollows 12 opened to a side face of a housing 11. A terminal 13 is inserted into each of the hollows 12. As well shown in FIG. 4, the terminal 13 crimps a cable C at an end portion thereof where an external cover C1 of the cable C is removed by a predetermined length and a core wire C2 is exposed. The terminal 13 comprises the first hold portion 13A for holding the external cover C1, the second hold portion 13B for holding the core wire C2, a leg portion 13C for stabling the position and posture of the terminal 13 in the hollow 12, and a leg-shaped contact portion 13D for being brought into contact with a contact plate of a mating connector. The first and second hold portions 13A and 13B have two legs, respectively, which extend from a U-shaped portion of the terminal 13 for accommodating the cable C. The legs of the first and second hold portions 13A and 13B are rounded by crimping process to firmly crimp the external cover C1 and the core wire C2 of the cable C, respectively. The leg portion 13C extends downwardly, that is, extends in a direction receding from the core wire C2, and the top edge (lower edge) thereof keeps in touch with the bottom of the hollow 12 to stable the position and posture of the terminal 13. The contact portion 13D provided on the top end (right-side end) of the terminal 13 also extends downwardly. As shown in FIG. 2, a throat portion 13D1, which is a narrowed portion provided in the contact portion 13D, is brought into resilient contact with the plate terminal of the mating connector. A lance 13E is provided on the top of the terminal 13 to engage the housing 11.

Figure 4:
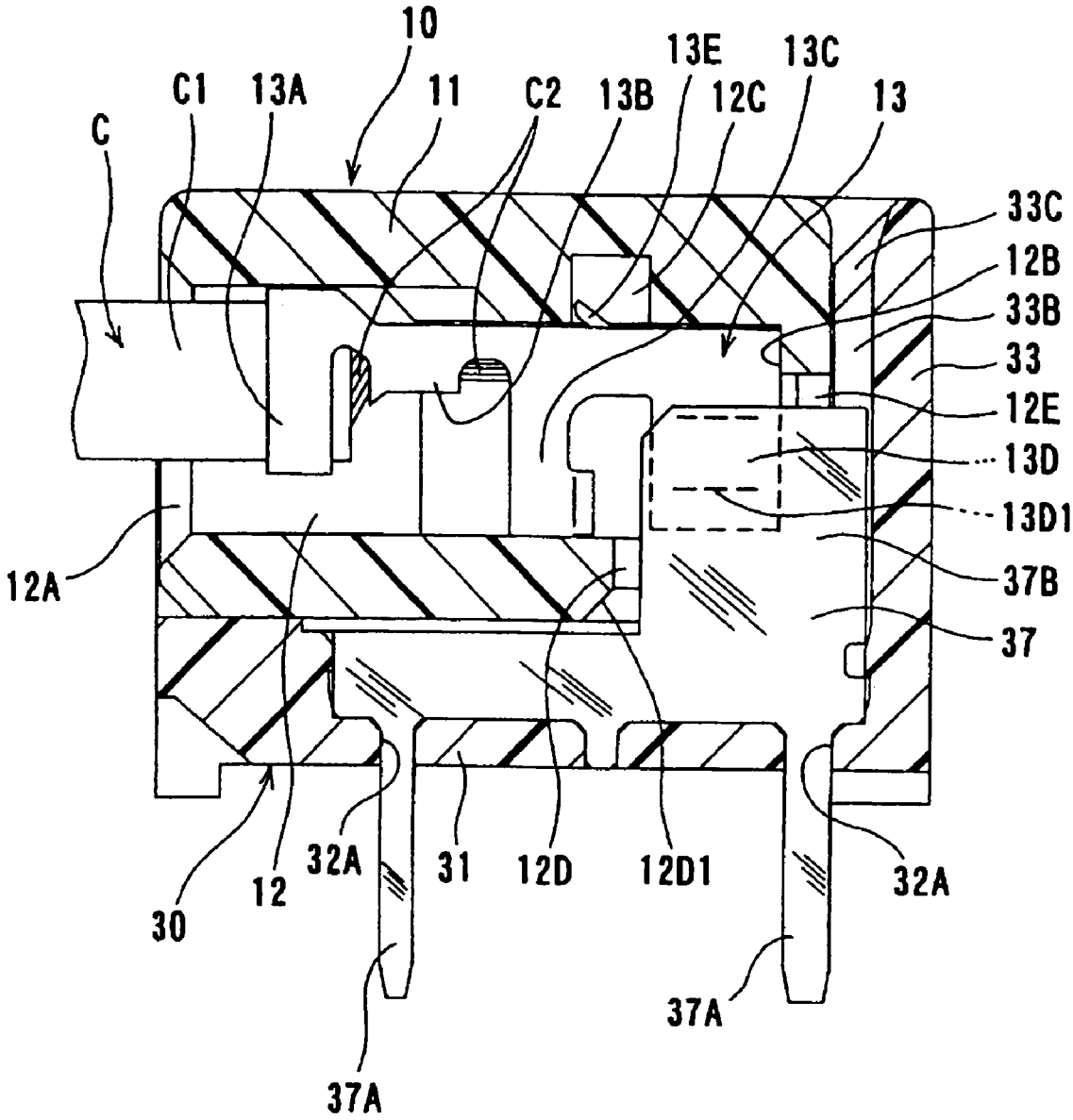
FIG. 4 is a sectional view of the electrical connectors taken along the line IV-IV of FIG. 1, showing the condition after the plug-in operation.

As shown in FIG. 4, the hollow 12 extends from an opening portion 12A provided in the side face of the housing 11 until the opposite side face in the longitudinal direction of the cable C. A step portion 12B is provided in the vicinity of the opposite side face. The top end of the terminal 13 abuts against the step portion 12B to determine the depth of the insertion of the terminal 13 into the hollow 12. The hollow 12 has a dent portion 12C in the lower side face of the upper wall of the housing 11. The dent 12C engages the lance 13E of the terminal 13. The hollow 12 has also slits 12D and 12E, which are provided through the lower wall and the opposite side face of the housing 11, respectively. The slits 12D and 12E provide flat spaces in parallel to the sheet of FIG. 4 to permit the below-mentioned contact portion of the plate terminal of the mating connector to pass through the spaces. The lower part of the slit 12D is tapered to provide a guide portion 12D1 for facilitating the insertion of the contact portion of the mating connector.

As shown in FIGS. 1 and 2, a pair of resilient arms 14 extend downwardly from the upper edges of side walls perpendicular to the side face where the openings 12A of the hollows 12 are provided. A base portion 14A connecting the resilient arm 14 and the housing 11 is made thinner than other portions of the resilient arm 14 to provide resilient flexibility and deformation. The resilient arm 14 is of a shape of plate becoming thicker toward the top (lower) end thereof and extends almost up to the lower edge of the housing 11. That is, the resilient arm 14 stays in the dimension of the housing 11 in the vertical direction. A flat operative portion 14B is provided in the lower external face of the resilient arm 14.

A pair of lock portions 15 projects from both side faces of the resilient arm 14 in the widthwise direction. The lock portions 15 are provided integrally with the resilient arm 14 in a range overlapping with that of the operative portion 14B in the extension direction of the resilient arm 14. Also, the two lock portions 15 are provided in a range overlapping with a range between the first and second hold portions 13A and 13B in the longitudinal direction of the cable C. It is preferable that the lock portions 15 stay in a range same as or outside the range between the first and second hold portions 13A and 13B. The inside face of the lock portion 15 facing the side wall of the housing 11 is flat and the outside face opposed to the inside face is tapered to provide two tapered faces, lower and upper faces 15A and 15B. The lower and upper tapered faces 15A and 15B are tapered such that the thickness of the lock portion 15 is maximum in the center in the vertical direction and gradually becomes smaller downwardly and upwardly.

A receiving dent 16 is provided in the lower face of the housing 11, passing through in the direction perpendicular to the sheet of FIG. 2. The receiving dent 16 receives a below-mentioned intermediate wall 42 of the mating connector and has a guide portion 16A tapered for facilitating the insertion of the intermediate wall 42. A dent portion 17 is provided in the side face of the housing 11 where the opening portions 12A of the hollows 12 are provided, passing through in the vertical direction.

As shown in FIG. 1, the mating connector 30 comprises side walls 33, 34, 35, and 36 standing upright from the four sides of a bottom wall 32 of a housing 31 and two side walls 34' and 35' lower than the four side walls 33, 34, 35, and 36 to define a space for receiving the electrical connector 10 from the upside. Three side walls 34 (34'), 35 (35'), and 36 have cut-off portions, which are cut off from the upper edges thereof. Tapered guide portions 33A, 34A, 35A, and 36A are provided at the upper inside edges of the four side walls 33, 34, 35, and 36 for facilitating the insertion of the electrical connector 10.

In FIG. 4, two apertures 32A are provided in the bottom wall 32 of the housing 31 in a range corresponding to the slits 12D of the connector 10, passing through in the vertical direction. Two leg-shaped connection portions 37A of the terminal 37 are press-fitted in the apertures 32A. As shown in FIG. 2, the terminal 37 has a shape of plate, which extends in the vertical direction and in the direction perpendicular to the sheet of FIG. 2. The terminal 37 comprises the two leg-shaped connection portions 37A at the lower end thereof and a plate-shaped contact portion 37B at the upper end thereof. The connection portions 37A are inserted into and soldered to corresponding holes provided in a circuit board (not shown) outside the housing 31 for electrical connection with the circuit board and for standing up excessive external forces. The contact portion 37B enters the throat portion 13D1 of the terminal 13 of the connector 10. As shown in FIGS. 1 and 4, the contact portion 37B is provided at right-handed side of the terminal 37 to correspond to the throat portion 13D1. A cut-off portion is provided at the upper left of the contact portion 37B to provide a space for receiving the connector 10.

As shown in FIGS. 1 and 4, side apertures 33B are provided in the side wall 33 to guide and support the plate terminal 37 when the connection portion 37A of the plate terminal 37 is press-fitted from the upside. A guide portion 33C is provided at the top edge of each side aperture 33B for facilitating the insertion of the terminal 37.

As shown in FIG. 1, a pair of the side walls 34 and 34', and 35 and 35' are provided symmetrically, opposing to each other. Cut-off portions 38 and 39 provided between the side walls 34 and 34', and 35 and 35', respectively, are opened to the upside to receive the resilient arm 14. Engaging hooks 40 and 41 project to the inside at the side edges of the cut-off portions 38 and 39 and the upper inside of the side walls 34, 34', 35, and 35'. The engaging hooks 40 and 41 are provided at positions corresponding to the positions of the lock portions 15 of the resilient arm 14 and furnished with tapered guide portions 40A and 41A on the top thereof to make easy the operation upon the start of the engagement.

Two cut-off portions 36B are provided in the side wall 36 at positions corresponding to the positions of the two cables C extending from the connector 10 and opened to the upside to receive the cables C. A post 36C provided between the two cut-off portions 36B enters the dent portion 17 of the connector 10 from the downside. An intermediate wall 42 extends upwardly and connects the post 36 and the side wall 33 to reinforce the housing 31. The intermediate wall 42 is inserted into the receiving dent 16 provided in the lower face of the housing 11 of the connector 10.

The two connectors 10 and 30 are electrically connected to each other in the following way. The terminal 13, which has been crimped to the cable C, is inserted into the hollow 12 and the lance 13E of the terminal 13 engages the dent portion 12C of the housing 11 to prevent the coming off of the terminal 13. When the connector 10 is plugged in the connector 30, the housing 11 is inserted into the space defined by the side walls 33, 34, 34', 35, 35', and 36. At this point, the terminal 37 of the connector 30 enters the throat portion 13D1 of the contact portion 13D of the terminal 13 of the connector 10 so that that both the terminals 13 and 37 are electrically connected.

Also, when the connector 10 is plugged in the connector 30, the cable C of the connector 10 extends from the cut-off portion 36B of the housing 31 of the connector 30 to the outside, and the resilient arm 14 of the connector 10 enters the cut-off portions 38 and 39 of the connector 30.

Figure 5:
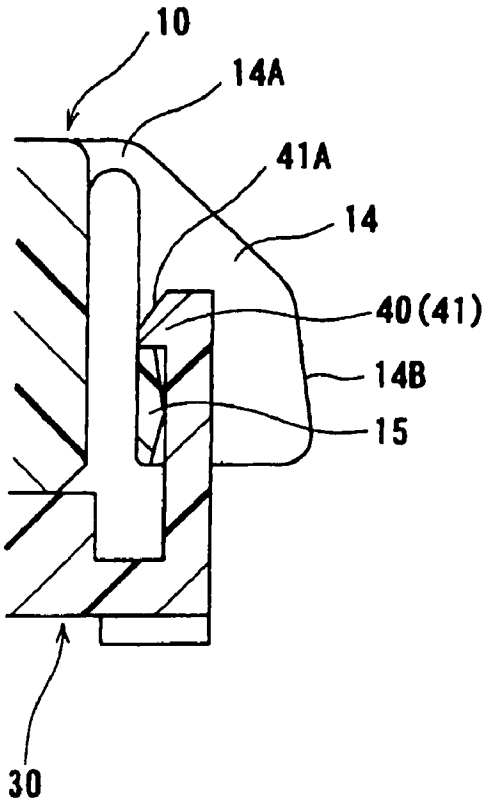
FIGS. 5(A), 5(B), and 5(C) are sectional views of a resilient arm, and locking and engagement portions of the electrical connectors, showing the condition before the start of the plug-in operation, the condition immediately before the completion of the plug-in operation, and the condition upon or after the completion of the plug-in operation, respectively.
Figure 5:
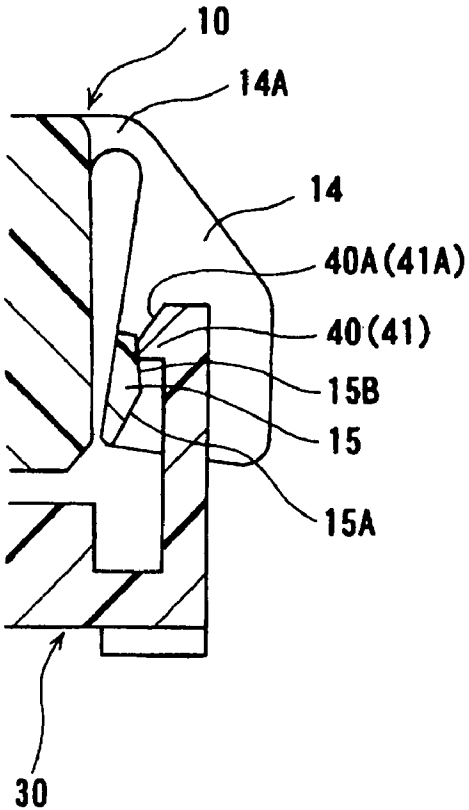
Figure 5:
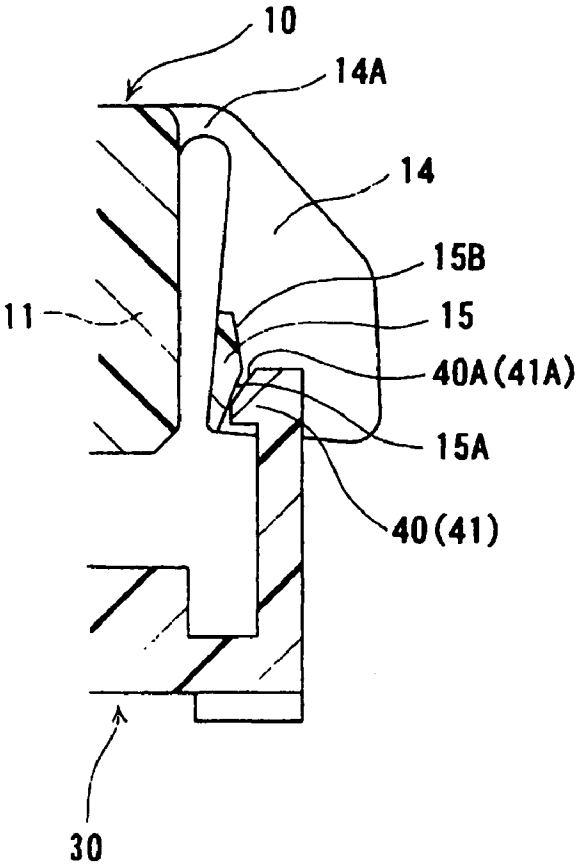

As shown in FIG. 5(A), when the lower tapered face 15A of the lock portion 15 receives the pushing force from the engagement portion 40 of the connector 30, the resilient arm 14 is resiliently flexed to the inside to enable the insertion of the connector 10. As shown in FIG. 5(B), when the insertion advances further, the engagement portion 40 abuts against the upper tapered face 15B. Since the upper tapered face 15B has a slope reverse to that of the lower tapered face 15A in respect to the vertical plane, the pushing force applied on the upper tapered face 15B from the engagement portion 40 generates a downward force, which accelerates the insertion of the connector 10. Thus, the plug-in between the connectors 10 and 30 is done easily.

When the insertion advances up to the position where the lock portion 15 passes the engagement portion 40, the resilient arm 14 is released from the resilient flexibility into the original free condition so that the engagement portion 40 engages the upper end of the lock portion 15 to prevent the coming off of the connector. Namely, the lock is completed.

When removing the connector 10 from the connector 30, the user holds the two operative portions 14B by his or her fingers to apply a pushing force to the resilient arm 14. The resilient arm 14 is resiliently flexed and deformed and when the amount of the displacement reaches a necessary level, that is, the thickness of the lock portion 15, the connector 10 becomes ready to be removed. In the present invention, since the resilient arm 14 and the operative portion 14B are provided at positions overlapping to each other in the removal direction of the resilient arm 14, the amount of the displacement for the lock and the amount of the displacement of the operative 14A for the release of the lock become substantially equal.

The invention claimed is:

1. An electrical connector comprising:

a housing;

a pair of resilient arms extending from said housing for resiliently flexing and deforming;

an operative portion provided on each of the resilient arms for applying an operative force to the resilient arms so that the resilient arms flex and deform;

a pair of lock portions provided on both sides of each of the operative portions for engagement with an engagement portion of a mating connector during a plug-in operation with said mating connector.

2. The electrical connector according to claim 1, wherein said lock portions and said operative portions are provided on different peripheral faces of said resilient arms.

3. The electrical connector according to claim 1, wherein said housing is connected to at least one cable, which extends from said housing at a position different from that of said resilient arms and in a direction perpendicular to a plug-in direction toward said mating connector.

4. The electrical connector according to claim 1, wherein said lock portions are projections having a tapered face, which receives, while abutting against said engagement portion of said mating connector, a pushing force from said engagement portions, said pushing force including a component of force in a plug-in direction toward said mating connector.

5. The electrical connector according to claim 2, wherein said lock portions are projections having a tapered face, which receives, while abutting against said engagement portion of said mating connector, a pushing force from said engagement portions, said pushing force including a component of force in a plug-in direction toward said mating connector.

6. The electrical connector according to claim 1, wherein said resilient arm is connected to said housing at a rear position in a plug-in direction of said housing into said mating connector and extends forwardly so that at least part of said resilient arm is accommodated in said mating connector during said plug-in operation.

7. The electrical connector according to claim 1, further comprising:

at least one terminal connected to a cable; and at least one crimp portion provided on said terminal for crimping said cable.

8. The electrical connector according to claim 1, wherein said housing includes a pair of base portions, said resilient arms extending from the base portions, respectively.

9. The electrical connector according to claim 8, wherein said operative portions are provided to be away from the base portions by a first distance.

10. The electrical connector according to claim 9, wherein said lock portions is provided to be away from the base portion by a second distance substantially the same as the first distance.

* * * * *